United States Patent [19]

Gray

[11] Patent Number: 4,920,581

[45] Date of Patent: May 1, 1990

[54] WAISTBAND REDUCER FOR PANTS

[76] Inventor: Ruben L. Gray, 5853 Cedar Ave., Philadelphia, Pa. 19143

[21] Appl. No.: 268,831

[22] Filed: Nov. 8, 1988

[51] Int. Cl.[5] ..... A41F 9/02

[52] U.S. Cl. ..... 2/237; 2/221

[58] Field of Search ..... 2/221, 237

[56] References Cited

U.S. PATENT DOCUMENTS

| | | | |
|---|---|---|---|
| 261,664 | 7/1882 | Brown . | |
| 592,001 | 10/1897 | Daum . | |
| 757,701 | 4/1904 | Wheless . | |
| 938,229 | 10/1909 | Goldberg . | |
| 983,449 | 2/1911 | Jones . | |
| 1,104,625 | 7/1914 | Caplan | 2/221 |
| 1,147,225 | 7/1915 | Feldman . | |
| 1,174,976 | 3/1916 | Gaines | 2/221 |
| 1,267,533 | 5/1918 | Francis . | |
| 1,365,749 | 1/1921 | Torcwiia | 2/221 |
| 1,368,866 | 2/1921 | Wander . | |
| 1,423,684 | 7/1922 | Rose . | |
| 1,488,587 | 4/1924 | Dochnal . | |
| 1,494,767 | 5/1924 | Biehl . | |
| 1,540,003 | 6/1925 | Haller . | |
| 1,823,296 | 9/1931 | Sekey | 2/221 |
| 1,826,803 | 10/1931 | Lubell . | |
| 2,131,654 | 9/1938 | Baer . | |
| 2,837,748 | 6/1958 | Manning et al. . | |
| 2,946,064 | 7/1960 | Dieterle . | |
| 2,999,246 | 9/1961 | Rowan | 2/221 |
| 4,580,298 | 4/1986 | Tuisi . | |
| 4,620,326 | 11/1986 | Matthias | 2/221 |
| 4,677,699 | 7/1987 | Barabe . | |

FOREIGN PATENT DOCUMENTS

| | | | |
|---|---|---|---|
| 1236284 | 6/1960 | France | 2/221 |

*Primary Examiner*—H. Hampton Hunter

*Attorney, Agent, or Firm*—Panitch, Schwarze, Jacobs & Nadel

[57] ABSTRACT

A waistband reducer for pants including an elongate generally elastic and flexible element or strap having a plurality of fastener elements for connection along a waistband to contract the waistband about the wearer's waist.

1 Claim, 1 Drawing Sheet

WAISTBAND REDUCER FOR PANTS

BACKGROUND OF THE INVENTION

As is well known, many pants are not provided with means for waist adjustment, or the means provided is not adequate for the range required. For example, it is common practice now to provide little or no adjustability, so that when the user loses weight, the pants no longer fit.

This has been a problem for many years, and applicant is aware of the below listed prior patents concerning this problem:

| NAME | PATENT NO. |
|---|---|
| A. Brown | 261,664 |
| G. D. Jones | 983,449 |
| Alfred K. Wander | 1,368,866 |
| F. Dochnal | 1,488,587 |
| A. P. Lubell | 1,826,803 |
| A. K. Baer | 2,131,654 |

SUMMARY OF THE INVENTION

It is an important object of the present invention to provide a waistband reducer for pants which is extremely simple to manufacture and use, effectively reduces the waist measurement of the pants, provides for a comfortable fit to the user, and may be quickly and easily applied to and removed from a pair of pants.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
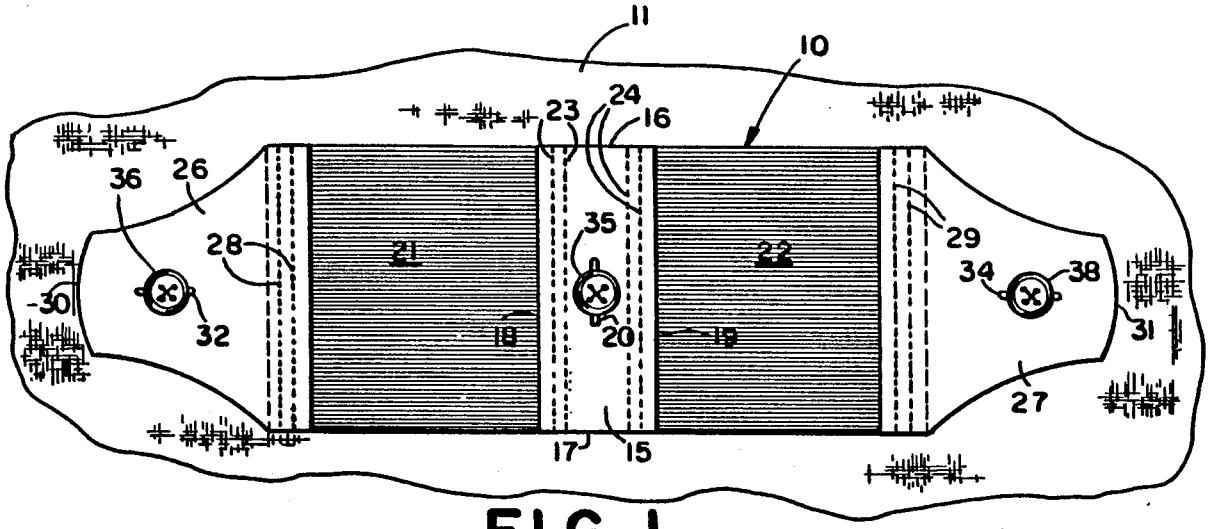
FIG. 1 is an elevational view showing a pants waist reducer of the present invention partially applied to a pair of pants.
Figure 2:
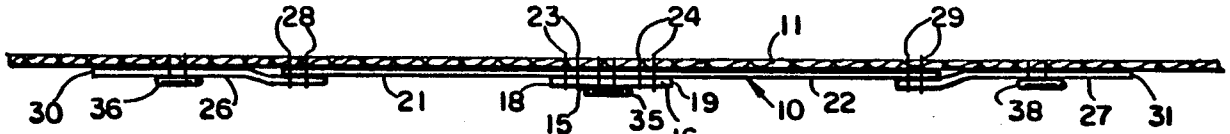
FIG. 2 is a top view taken generally along the line 2—2 of FIG. 1.

Referring now more particularly to the drawings, and specifically to FIG. 1 thereof, a pants waist reducer of the present invention is there generally designated 10, and is shown in position being applied to the inside, rear waistband area 11 of a pair of pants 12. That is, the area designated 11 is the rear inner waistband portion of the pants 12.

The waistband reducer 10, includes a medial portion or panel 15 which may be generally rectangular in configuration and advantageously fabricated of leather or other suitable material having similar flexibility and wear resistance characteristics.

The medial panel 15, may be generally rectangular, having upper and lower generally horizontal edges 16 and 17, and first and second parallel generally vertical side edges 19 and 18, respectively. Generally centrally of the panel 15 is a fastener element 20, such as a buttonhole, or other fastener element.

Extending laterally outwardly from each side edge 18 and 19 of the middle panel 15 is an intermediate panel, as at 21 and 22, which is advantageously of an elastic material, say stretching elastically in opposite directions outwardly from the center panel 15. That is, a first generally vertically extending side edge of the elastic panel 21 is suitably secured, as by stitching 23, along the edge 18 of medial panel 15; and similarly, a second generally vertically extending side edge of the elastic panel 22 is secured along side edge 19 of medial panel 15, as by stitching 24.

That is, the elastic panels 21 and 22 are similar to each other, being in substantial alignment, approximately of equal length and generally coextensive in the vertical direction.

Extending from the outer end region or generally vertically extending second side edges of each panel 21 and 22 is an end panel, as at 26 and 27. The end panels 26 and 27 extend oppositely outwardly from respective elastic panels 21 and 22, and may taper in transverse dimension for convenience.

More specifically, the end panels 26 and 27 may be suitably secured, along the vertically extending base portion thereof respectively, to the second side edges of the intermediate panels 21 and 22, by stitching 28 and 29, or other suitable securing means. The tapering end panels may advantageously be fabricated of leather or leather like material, having side edges tapering or convergent toward end edges 30 and 31, respectively.

Generally centrally of each end piece 26 and 27, there is provided a fastener element, as at 32 and 34, which may be buttonholes, or other suitable fastener element.

The central fastener element 20 may also be a buttonhole, and located generally in alignment with and between the buttonholes 32 and 34. For proper buttonhole location and stress, the central buttonhole 20 may extend transversely of the reducer device 10, while the end buttonholes 32 and 34 may extend longitudinally of the reducer device.

Secured to the waistband 12 of the pants 11, on the inner side thereof is a button 35, which may be located centrally of the waistband on the rear side thereof, and of a size for cooperation with the buttonhole 20.

Also, additional buttons 36 and 38 may be secured on the inner side of the pants waistband 11 for location beyond opposite ends of the reducer device 10. The buttons 35, 36 and 38 are generally horizontally aligned, and the buttons 36 and 38 are spaced outward beyond their respective buttonholes 32 and 34 a distance sufficient to contract the pants as desired.

By this simple construction the pants will be contracted or reduced in the waist an amount according to the spacing of the buttonholes 32 and 34 from respective buttons 36 and 38. Also, due to the longitudinal arrangement of buttonholes 32 and 34, the buttonholes will not be spread apart and there will be little or no tendency for the buttons to inadvertently come out of the buttonholes.

While buttons and buttonholes are preferred, as described above, other fasteners may also be employed, for instance complementary fastener fabric of the type known a Velcro.

Although the present invention has been described in some detail by way of illustration and example for purposes of clarity of understanding, it is understood that certain changes and modifications may be made within the spirit of the invention. For example, the buttons 32 and 34 may be provided on the exterior of the pants, as well as the button 20, to locate the waist reducer 10 on the exterior of the pants. If desired, buttons may be located both on the interior and exterior of the pants for selective use of the waist reducer either interiorly or exteriorly of the pants.

What is claimed is:

1. A waistband reducer for pants comprising:

a generally rectangular medial panel constructed of leather, and having first and second generally vertically extending side edges, said medial panel including a generally vertically extending button hole centrally disposed therein for receiving a central button connected to a pair of pants therethrough;

first and second elastic generally identical and rectangular side panels each having a first and second generally vertically extending side edge, said first and second side edges of said side panels being of the same vertical length as the medial panel side edges, said first side edge of said first side panel being secured to said first side edge of said medial panel by stitching extending completely therealong and said first side edge of said second side panel being secured to said second edge of said medial panel by stitching extending completely therealong such that said side panels extend from opposite sides of said medial panel for location along the waistband of the pair of pants;

first and second generally trapezoid-like flexible inelastic end panels each having a vertically extending base portion, said first and second side edges of said side panels being of the same vertical length as the base portions, said second side of said first side panel being secured to said base portion of said first end panel by stitching extending completely therealong and said second side of said second side panel being secured to said base portion of said second end panel by stitching extending completely therealong, said end panels being constructed of leather and including generally horizontally extending button holes therein for receiving additional buttons connected to the pair of pants therethrough, said medial panel button hole and said horizontally extending button holes all being generally linearly arranged on said waistband reducer, whereby complementary buttons on the waistband of the pants effect resilient contraction of the waistband when said central button and additional buttons are positioned through the complementary button holes.

* * * * *